United States Patent [19]

Gilchrist, Jr.

[11] Patent Number: 4,957,203

[45] Date of Patent: Sep. 18, 1990

[54] GARMENT COVER

[76] Inventor: William T. Gilchrist, Jr., 935 Brookridge Dr., Camden, Ark. 71701

[21] Appl. No.: 453,855

[22] Filed: Dec. 20, 1989

[51] Int. Cl.[5] ..... B65D 85/18

[52] U.S. Cl. ..... 206/286; 206/390

[58] Field of Search ..... 206/286, 287, 390

[56] References Cited

U.S. PATENT DOCUMENTS

| | | | |
|---|---|---|---|
| 2,000,324 | 5/1935 | Fleischer | 206/386 |
| 4,195,787 | 4/1980 | Thomason | 206/390 |
| 4,361,231 | 11/1982 | Patience | 206/386 |
| 4,677,697 | 7/1987 | Hayes | 206/390 |

*Primary Examiner*—Joseph Man-Fu Moy

[57] ABSTRACT

A roll of garment covers comprising of two sheets which are bonded together in selected areas and a plurality of perforated lines so that a single cover may be readily removed from the roll.

4 Claims, 1 Drawing Sheet

GARMENT COVER

This invention relates to garment covers of the type that slips over a garment on a hanger to protect the garment from dust and the like. The use of such covers has become an accepted step in the dry cleaning industry, in particular.

The garment covers must be manufactured in an inexpensive manner as well as made from inexpensive material to be competitive in the market place. Storage of the covers is also a factor to be considered since the user must have a large volume available at all times.

The present invention provides a method of producing garment covers at a low cost. The invention also provides garment covers in roll form so that they can be conveniently stored. The garment covers are individually removed from the roll as needed.

The concept of providing garment covers in roll form is not new as disclosed by Levy et al. 3,865,235 and 3,181,773. In these rolls, there is considerable waste of material between the tearoff line and the top of the cover. While such waste does not appear to be sizeable, it becomes an expensive problem when one looks at the large volume of covers consumed.

This invention eliminates waste which results in an economic advantage over the prior art. It also eliminates the nuisance of handling the waste material.

The invention will be more readily understood from the following description, taken in connection with the accompanying drawing.

Figure 1:
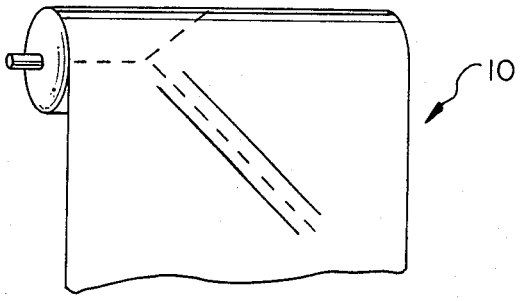
Figure 2:
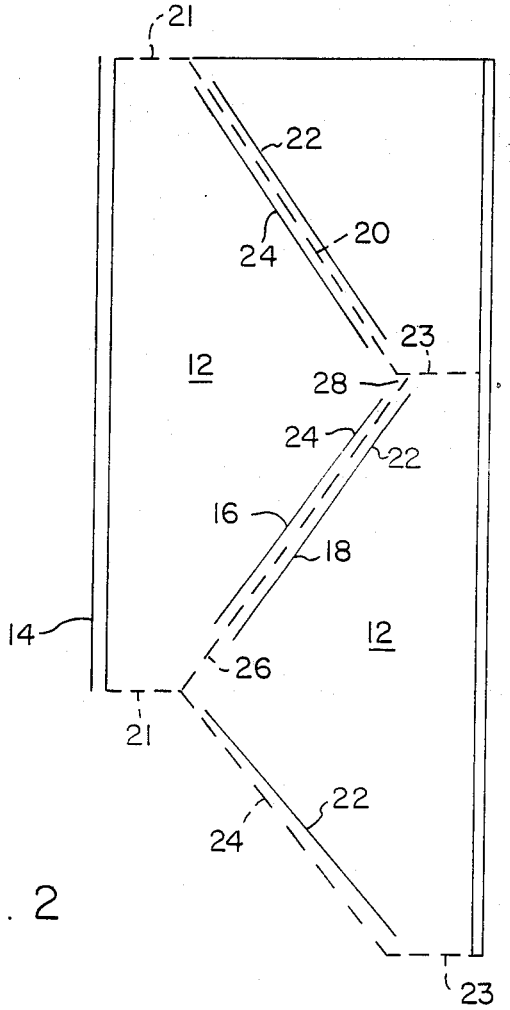

FIG. 1 is a perspective view of the garment cover roll supported in a dispensing mode, and FIG. 2 is a plan view of several connected garment covers.

The garment covers 10 are formed of two sheets 12 and 14 of tissue like paper. The garment covers could also be made of plastic if so desired. In this event, the two sheets would be bonded together by heating means in lieu of adhesive. Sheet 12 is of a width slightly less than the width of sheet 14, the purpose of which will become apparent later.

The two sheets 12 and 14 are bonded together only at lines 16 and 18 which extend in a zig zag fashion along the length of the sheets. The sheets are bonded with a suitable adhesive. If the sheets 12 and 14 are plastic, they may be heat sealed together in a well known manner.

A line 20 of perforations is formed midway between the lines 16 and 18 and extends continuously throughout the length of the roll of covers. The perforations form a tear line of the covers and are formed by conventional means. Perforations 21 and 23 extend transversely from the line 20 to the edges of the sheets.

The lines 16 and 18 are not continuous but are formed of spaced portions 22 and 24 leaving unbonded areas at 26 and 28.

When a single cover 12 is removed from a roll, the unbonded area forms an opening to receive the hook of a garment hanger.

When it is desired to use a garment cover, one needs only to give it a tug, thus separating the cover along the tear line from the roll.

The hanger hook with a garment thereon is moved through the opening 26. Due to the different widths of the sheets 12 and 14, there is formed tab portions 30 and 32 which facilitate opening the bottom of the covers to insert the hanger therein. The bonds form portions which cover the body of the hanger.

There is absolutely no waste material with this invention thus providing an economical and convenient supply of garment covers.

I claim:

1. The method of forming garment covers comprising bonding a first sheet to a second sheet of a lesser width than that of the first sheet, the bonding area comprises a plurality of parallel linear sections extending in a zig zag pattern throughout the length of the sheets, forming a first continuous line of perforations between said bonded sections, forming a second line of perforations extending laterally from said first line of perforations laterally to one edge of the sheets, forming a third line of perforations extending from said first line of perforations to the other edge of said sheets and winding said sheets into a roll.

2. The method of forming garment covers as set forth in claim 1 wherein said bonded areas are joined by adhesive.

3. The method of forming garment covers as set forth in claim 1 wherein said bonded areas are formed by heat sealing.

4. A roll of garment covers comprising a first sheet of flexible material, a first line of perforations extending in a zig zag pattern lengthwise of the sheets, a selected portion of said sheets being bonded together adjacent each side of said perforations, a second line of perforations extending laterally from said first line of perforations to one edge of said sheets, and a third line of perforations extending from said first line of perforations to the other edge of said sheets.

* * * * *